US011480403B2

(12) United States Patent
Balhan et al.

(10) Patent No.: US 11,480,403 B2
(45) Date of Patent: Oct. 25, 2022

(54) MAGAZINE LATCH

(71) Applicant: FN Herstal S.A., Herstal (BE)

(72) Inventors: Laurent Balhan, Mormont (BE); Dorian Delvaux, Oupeye (BE); Charles-Aurèle Gielen, Amay (BE); André Kartheuser, Malmedy (BE)

(73) Assignee: FN Herstal S.A.

( * ) Notice: Subject to any disclaimer, the term of this patent is extended or adjusted under 35 U.S.C. 154(b) by 0 days.

(21) Appl. No.: 17/434,157

(22) PCT Filed: Feb. 21, 2020

(86) PCT No.: PCT/EP2020/054624
§ 371 (c)(1),
(2) Date: Aug. 26, 2021

(87) PCT Pub. No.: WO2020/178049
PCT Pub. Date: Sep. 10, 2020

(65) Prior Publication Data

US 2022/0170710 A1 Jun. 2, 2022

(30) Foreign Application Priority Data

Mar. 1, 2019 (EP) ..... 19160300

(51) Int. Cl.
*F41A 17/38* (2006.01)
*F41A 35/06* (2006.01)

(52) U.S. Cl.
CPC ..... *F41A 17/38* (2013.01); *F41A 35/06* (2013.01)

(58) Field of Classification Search
CPC ..... F41A 17/38; F41A 35/06
USPC ..... 42/70.11, 70.01, 70.02
See application file for complete search history.

(56) References Cited

U.S. PATENT DOCUMENTS 827,259 A * 7/1906 Mcclean ..... F41A 11/02 89/142
1,648,469 A * 11/1927 Stambaugh ..... F41A 9/42 89/33.02
1,743,472 A * 1/1930 Meyer ..... F41A 3/26 89/14.3

(Continued)

FOREIGN PATENT DOCUMENTS

FR 2513749 4/1983

OTHER PUBLICATIONS

European Patent Office, International Search Report and Written Opinion for international Application No. PCT/EP2020/054624, dated Apr. 17, 2020.

*Primary Examiner* — Michael D David
(74) *Attorney, Agent, or Firm* — Williams Mullen; Thomas F. Bergert

(57) ABSTRACT

The present invention relates to an unlocking mechanism of a pistol magazine comprising at least one control button (2, 9) arranged on the flank of a grip (1) in which a magazine (3) can be inserted, each control button (2, 9) being attached to one end of a control lever (4, 5) controlling the rotation of a latch cam (8) arranged in front of or behind the grip (1), said latch cam (8) comprising a latch (13), cooperating, during use, with a stop surface (15) arranged on the front or rear surface of the magazine (3) in order to lock or unlock said magazine (3), at least one spring (6) keeping the latch cam (8) in the locked position of the magazine in the absence of pressure exerted on the control button (2, 9).

4 Claims, 3 Drawing Sheets

(56) References Cited

U.S. PATENT DOCUMENTS

| | | | | |
|---|---|---|---|---|
| 2,041,015 | A * | 5/1936 | Onorati | F41A 19/21 89/194 |
| 4,326,353 | A | 4/1982 | Ludwig et al. | |
| 4,949,492 | A | 8/1990 | Clifton | |
| 2003/0089018 | A1* | 5/2003 | Reynolds | F41A 3/38 42/105 |
| 2014/0230297 | A1 | 8/2014 | Larson et al. | |

* cited by examiner

MAGAZINE LATCH

CROSS-REFERENCE TO RELATED APPLICATIONS

This application is the U.S. national phase of international application PCT/EP2020/054624, filed on Feb. 21, 2020, which claims the benefit of European application EP 19160300.0 filed on Mar. 1, 2019; all of which are hereby incorporated herein in their entirety by reference.

SUBJECT-MATTER OF THE INVENTION

The present invention relates to a device for locking and releasing a magazine of a firearm, preferably of the pistol type.

BACKGROUND OF THE INVENTION

Automatic and semiautomatic firearms supplied by magazine comprise means locking the magazine during the use of the weapon. In the case of rifles or assault rifles, the magazine is generally arranged in a magazine well arranged in front of the trigger guard in the case of conventional rifles of the FN FNC or AK47 type or behind it in the case of bullpup-type weapons. In this case, the control of the magazine lock is generally arranged in the carcass and requires moving the hands to change magazine.

In the case of semiautomatic handguns of the pistol type, the magazine is generally arranged in the grip itself and is locked using a pushbutton that can be translated perpendicular to the handle and the axis of the barrel in order to unlock the magazine. This magazine latch is arranged close to the normal position of the thumb during firing, so as to allow an easy ejection of the empty magazine at the end of the firing sequence, and reloading without changing the firing position of the hand engaged on the grip.

The speed of magazine changing is further improved by the presence on the magazine board of a protuberance actuating a slide catch (or slide lever) keeping the slide and/or the breech at the rear after firing the last cartridge. The stopping of the breech at the rear indicates to the shooter that there are no cartridges left, and simplifies reloading, the breech being in position to reload a new cartridge of a new magazine.

Nevertheless, this type of magazine latch has at least two drawbacks. On the one hand, the position and the type of movement by simple pressing by the thumb can cause an untimely release of the magazine due to a false movement by the shooter, and on the other hand, the position of the thumb must be adapted to the right-handed or left-handed grip of the shooter.

One of the aims of the present invention is therefore to propose a magazine latch reducing the likelihood of an unwanted release of the magazine. According to preferred embodiments of the invention, the magazine latch mechanism must allow an ambidextrous use of the weapon in question.

Ideally, ambidextrous devices must allow a release from one side, without causing movement on the other side. Indeed, the activation button can be located below the palm or the index finger of the opposite face, which could cause friction preventing an easy release of the latch.

BRIEF DESCRIPTION OF THE INVENTION

The present invention relates to an unlocking mechanism of a pistol magazine comprising at least one control button arranged on the flank of a grip in which a magazine can be inserted, each control button being attached to one end of a control lever controlling the rotation of a latch cam arranged in front of or behind the grip, said latch cam comprising a latch, cooperating, during use, with a stop surface arranged on the front or rear surface of the magazine in order to lock or unlock said magazine, at least one spring keeping the latch cam in the locked position of the magazine in the absence of pressure exerted on the control button.

According to preferred embodiments of the invention, the unlocking mechanism for a pistol magazine of the invention includes at least one, or an appropriate combination, of the following features:

- the mechanism comprises two control buttons arranged to the right and left of the grip, each control button being attached to one end of a control lever controlling the rotation of the locking cam, making it possible to unlock the magazine by actuating the right or left control button;
- each control lever comprises a control lever lug bearing on a corresponding latch cam lug of the latch cam, the latch cam being rotated when one of the control buttons is actuated;
- the mechanism comprises a latch cam return spring keeping the latch cam in the locked position and two control lever springs keeping the control levers in the locked position, so as to make the movement of the left and right control buttons independent of one another;
- the latch cam is arranged behind the grip.

A second aspect of the invention relates to a pistol comprising an unlocking mechanism of the magazine according to the invention.

Preferably, the pistol of the invention comprises a frame guiding a slide and a carcass covering said frame, the latch cam axis being attached on the frame.

Advantageously, the frame is made from metal while the carcass is polymeric.

NUMERICAL REFERENCES OF THE FIGURES

Figure 1:
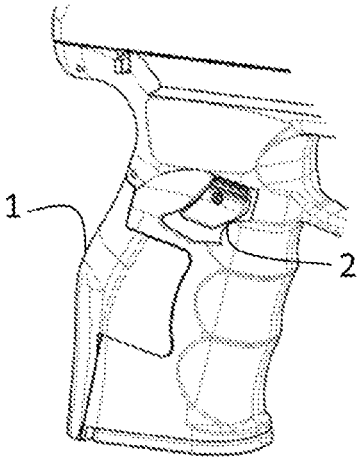
FIG. 1 shows an exemplary pistol grip comprising a magazine latch according to the invention.

1. Handle
2. Right control button
3. Magazine
4. Right control lever
5. Left control lever
6. Latch cam return spring
7. Latch cam lug
8. Latch cam
9. Left control button
10. Right control lever lug

11. Latch cam axis
12. Right control lever return spring
13. Latch of the latch cam
14. Detail shown in FIGS. 6 and 7
15. Stop surface of the magazine

DETAILED DESCRIPTION OF THE INVENTION

The present invention relates to a magazine unlocking mechanism, in particular a magazine unlocking mechanism integrated into a semiautomatic pistol.

Figure 2:
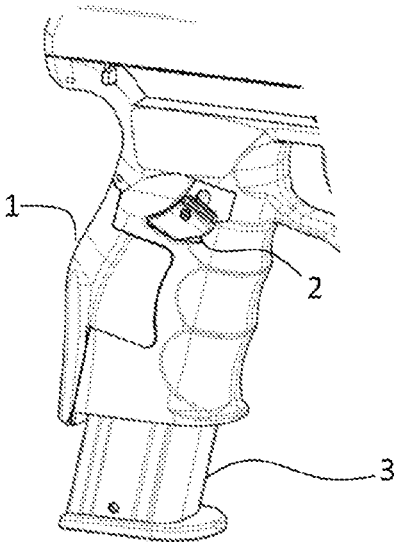
FIG. 2 shows the pistol grip of FIG. 1 in the unlocked position.

As shown in FIGS. 1 and 2, the magazine latch control 2 is arranged on the flank of the grip 1. As shown in these figures, the unlocking control is obtained by moving this control 2 from top to bottom, not by lateral pressure on a pushbutton. This makes it possible to prevent poorly controlled pressure from the thumb from unlocking the magazine 3, despite a position of the control 2 in a position normally occupied by the thumb of the shooter during the use of the weapon.

Figure 3:
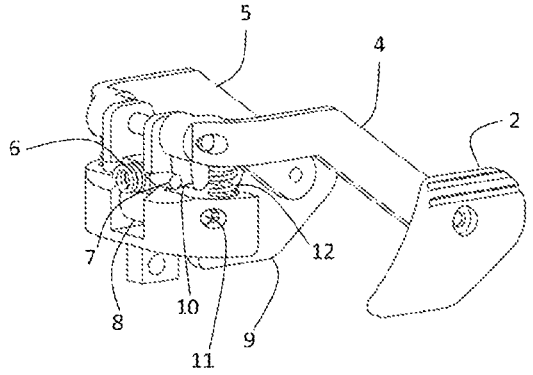
FIG. 3 shows a perspective view of an exemplary magazine latch according to the invention.
Figure 4:
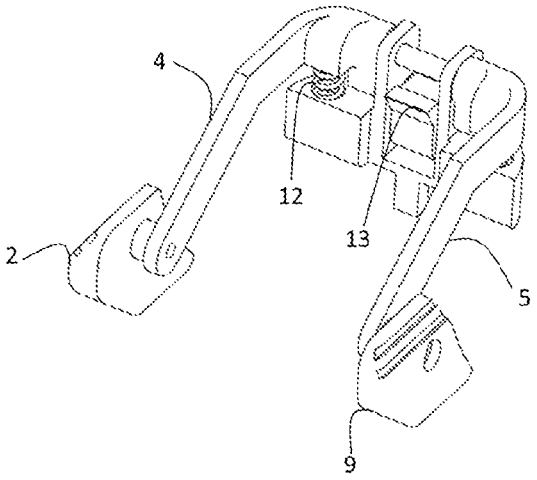
FIG. 4 shows another perspective view of the exemplary magazine latch of FIG. 3.
Figure 5:
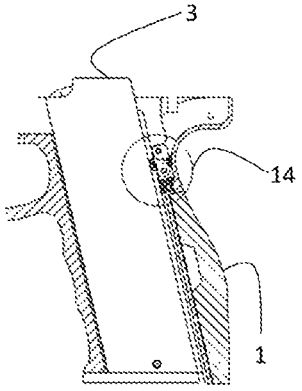
FIG. 5 shows a cross-sectional view of a magazine grip comprising a magazine latch according to the invention.

As shown in FIGS. 3 and 4, the control buttons 2, 9 are arranged at the ends of two levers 4, 5. These levers make it possible not only to position the control buttons 2, 9 in the location allowing the best ergonomics (distance between the rear of the handle and the last phalanx of the thumb), but also make it possible to increase the travel necessary to unlock the magazine. A longer travel reduces the likelihood of unwanted unlocking, while a shorter travel improves the ease of use.

Of course, a single lever and control button could suffice to unlock the magazine and would in itself have the advantage of the top to bottom movement, and the determination of an appropriate control travel. Nevertheless, in this case, the weapon could not easily be adapted to all shooters and it would be necessary to have specific devices for right-handed shooters and left-handed shooters. Therefore, advantageously, the latch according to the invention comprises a control button on each side of the grip.

Figure 6:
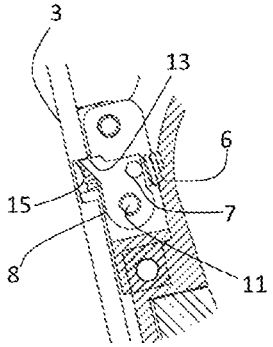
FIG. 6 shows an enlarged view of area 14 of FIG. 5, with the magazine locked.
Figure 7:
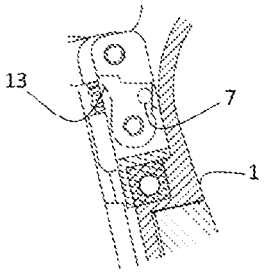
FIG. 7 shows an enlarged view of area 14 of FIG. 5, with the magazine unlocked.

As shown in FIGS. 6 and 7, the unlocking strictly speaking is obtained by rotating a cam 8 turning about an axis 11. This cam 8 comprises a stop surface 13 cooperating with a corresponding stop surface 15 on a rear face of the magazine 3.

In the case of a non-ambidextrous mechanism, comprising a single control button 2, 9 and a single lever 4, 5, the rotation of the latch cam 8 can simply be obtained by securing the lever 4, 5 to said latch cam 8. In this case, a single spring 6, 12 acting either on the cam 8, or below the lever 4, 5, suffices to return the latch to the locked position after loading.

In the case of an ambidextrous mechanism, if the two levers 4, 5 are secured to the cam 8, the two control buttons 2, 9 will move jointly. This joint movement can pose reliability problems in the case where the button on the side of the palm of the shooter's hand is located at the base of the index finger, or below part of the palm exerting strong pressure on the corresponding button. Indeed, in this case, the pressure from the palm or the base of the index finger could prevent the unlocking movement, or worse, return of the latch to the locking position. In this case, it could be complicated to replace a new magazine reliably. Therefore, advantageously, the two control levers 4, 5 actuate the latch cam by simple bearing of a control lever lug 10, on a corresponding latch cam lug 7 on the latch cam 8.

In this case, a latch cam spring 6 ensures the return of the latch cam 8 irrespective of the actuated button 2, 9 (that is to say, left or right). Two separate springs ensure the return of the two levers 4, 5 independently. This variant therefore makes it possible to make the movement of the two independent.

One skilled in the art will easily understand that while the ideal ergonomics are indeed obtained by placing the latch cam 8 behind the grip 1 (length of the levers substantially equal to the length of a thumb), this device could be transposed symmetrically in front of the handle.

In many recent semiautomatic pistols, the guiding function of the moving parts in general, and of the slide in particular, is uncoupled from the gripping function of the weapon by the use of a metal frame comprising rails on which the slide slides during the cycle of the weapon. A carcass comprising the grip supports this frame. This grip comprises a magazine well in which the magazine is inserted. Advantageously, the axis of the latch cam 11 is attached to the frame and not to the carcass, so as to improve the positioning of the head of the magazine (and as a result, the positioning of the cartridge to be loaded) relative to the slide in order to avoid reloading problems during the cycle of the weapon.

The invention claimed is:

1. An unlocking mechanism of a pistol magazine comprising at least one control button arranged on a flank of a grip in which a magazine can be inserted, each control button being attached to one end of a control lever controlling the rotation of a latch cam arranged in front of or behind the grip, said latch cam comprising a latch, cooperating, during use, with a stop surface arranged on the front or rear surface of the magazine in order to lock or unlock said magazine, at least one spring keeping the latch cam in the locked position of the magazine in the absence of pressure exerted on the control button, the unlocking mechanism comprising two control buttons arranged to the right and left of the grip and each control lever comprising a control lever lug bearing on a corresponding latch cam lug of the latch cam, the latch cam being rotated when one of the control buttons is actuated and the unlocking device comprising a latch cam return spring keeping the latch cam in the locked position and two control lever springs keeping the control levers in the locked position, so as to make the movement of the left and right control buttons independent of one another.

2. The pistol according to claim 1, wherein the latch cam is arranged behind the grip.

3. The pistol according to claim 1, comprising a frame guiding the slide and a carcass covering said frame, the latch cam axis being attached on the frame.

4. The pistol according to claim 3, wherein the frame is made from metal while the carcass is polymeric.

* * * * *